United States Patent [19]

Thomas

[11] 3,955,630

[45] May 11, 1976

[54] ELECTROSTATIC DEVICE AND GAME

[76] Inventor: John C. Thomas, 451 Queensboro Lane, Haddonfield, N.J. 08033

[22] Filed: Feb. 13, 1975

[21] Appl. No.: 549,713

[52] U.S. Cl. ..... 273/153 R; 46/233; 273/95 R; 273/113

[51] Int. Cl.[2] ..... A63F 7/04

[58] Field of Search ..... 273/108, 109, 113, 115, 273/116, 118 R, 118 A, 123 A, 95 R, 138 A, 153 R; 46/233; 272/1 R, 8 N; 40/106.25

[56] References Cited

UNITED STATES PATENTS

| | | | |
|---|---|---|---|
| 749,351 | 1/1904 | Arnold | 273/109 |
| 876,820 | 1/1908 | Maltbie | 273/95 R |
| 930,704 | 8/1909 | Sullivan | 273/108 |
| 1,230,309 | 6/1917 | McNally | 273/113 |
| 3,158,955 | 12/1964 | Sturgis | 46/233 |
| 3,778,927 | 12/1973 | Edden | 46/233 |

*Primary Examiner*—Anton O. Oechsle
*Assistant Examiner*—Harry G. Strappello

[57] ABSTRACT

An amusing and challenging device composed of a closed container divided into a plurality of chambers by a barrier, or barriers, and a plurality of movable bodies, usually spherical, encased therein. The container, barrier and movable bodies are of electrically insulating material and the movable bodies are of such small size that after the container is agitated, a sufficient static electrical charge is produced by the friction on the movable bodies so as to cause them to adhere to the walls of the chambers. The objective of this device is to challenge ones ability to locate all of the movable objects into one chamber after the unit has been sufficiently agitated, therefore the container and barriers are made of transparent materials to allow easy viewing of the objects therein. In the presently preferred form of the device there is one barrier, dividing the container into two chambers, and a plurality of movable spherical objects.

2 Claims, 4 Drawing Figures

ELECTROSTATIC DEVICE AND GAME

This invention relates to devices for challenging ones ability to locate objects in a given area and more particularly to a device that is affected by a static electrical charge.

As is well known, static electricity is an electrical charge that is at rest and is produced by friction, by heating, by pressure, and by electrostatic induction. This static electricity creates an electric field, which in turn causes an electric adhesion or electric repulsion between affected objects.

Often this attraction, or repulsion, can be made so intense by agitation that it is difficult to separate, or join, the involved objects. However, there has been no practical, convenient, or challenging device which can be used as a game for individuals or groups.

Accordingly, it is an object of this invention to provide a novel and challenging device for entertainment wherein the component parts are all within a single sealed unit.

It is still another object of this invention to provide a device that creates the same challenge to all who attempt to solve it.

Generally, the invention relates to a cylindrical shell closed at both ends into which is confined a partial barrier and a quantity of small movable objects capable of retaining a static electric charge.

Other objects and advantages of the subject invention will be apparent from a detailed description of presently preferred forms of the invention which are described herein wherein.

Figure 1:
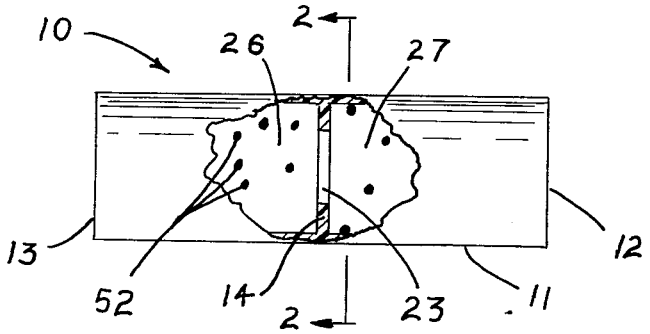
FIG. 1 is a side view, partially in section, of a device constructed in accordance with a presently preferred form of the invention.
Figure 2:
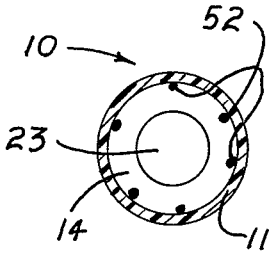
FIG. 2 is a sectional view taken along line 2 — 2 of FIG. 1.

The invention can best be described by referring to FIG. 1 and FIG. 2 wherein a device 10, constructed in accordance with a presently preferred form of the invention, is illustrated.

The container of the device 10 is a generally elongated cylindrical member 11 having both ends 12 and 13 sealed, thereby making a completely closed unit. The axis of the cylindrical member 11 is at substantially right angles to the surfaces of these ends 12 and 13. Within the cylindrical shell 11 at some point between the ends 12 and 13 a barrier 14 is placed, also at substantially right angles to the axis of the cylindrical member. This barrier 14 divides the interior volume into two volumes, 26 and 27, while allowing access between the two volumes by means of an orifice 23.

All of the aforementioned component parts are made of transparent materials so that any foreign body contained within the shell of the device can easily be observed.

Within the two volumes of the device there are a quantity of balls, 52, which, when the device is moved with a sudden motion, will move relative to the assembled shell.

Figure 3:
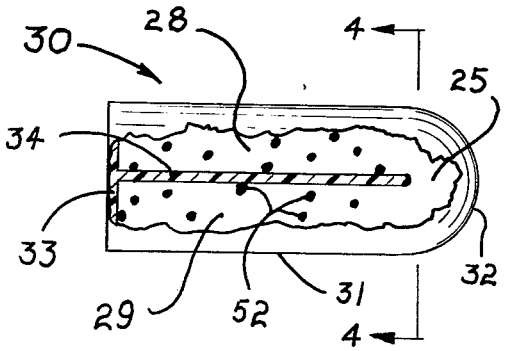
FIG. 3 is a side view, partially in section, of a device constructed in accordance with a presently preferred form of the invention, but a different form than that shown in FIG. 1.
Figure 4:
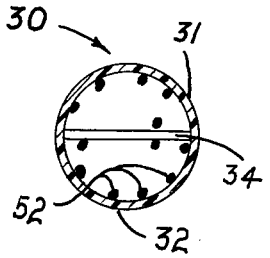
FIG. 4 is a sectional view taken along line 4 — 4 of FIG. 3

The invention can further be best described by referring to FIG. 3 and FIG. 4 wherein a device 30, constructed in accordance with a presently preferred form of the invention, is illustrated.

The container of the device 30 is a generally elongated cylindrical member 31 having both ends 32 and 33 sealed, thereby making a completely closed unit. The axis of the cylindrical member is at substantially right angles to the surface of end 33. End 32 is substantially a semispherical shape, but that is not a requisite.

Within the cylindrical shell and attached along three sides is a barrier 34. This barrier is generally at substantially right angles and attached to the end 33. Its purpose is to divide the interior volume of the cylindrical portion of the device into two volumes, 28 and 29, but leaving a passageway 25 within the end 32.

All of the aforementioned component parts in FIG. 3 and FIG. 4 are made of transparent materials so that any foreign body contained within the shell of the device 30 can be observed.

Within the two volumes of the device there are a quantity of balls, 52, which, when the device is moved with a sudden motion, will move relative to the assembled shell.

The articles used to comprise the two aforementioned devices shown in FIG. 1 through FIG. 4 are all made of materials that are capable of obtaining and retaining a static electric charge.

When the device is in its normal, non-charged condition, the balls 52 rest on the lowermost walls of the unit because of gravity, but when the device is agitated they build up a static charge and adhere to the side and top walls as well as the lowermost walls. The surface area of the path around the barrier is smaller than that of the side walls so that the friction of the balls is greater on the side walls, which in turn causes the side walls to obtain the greater static electrical charge. This greater static electrical charge causes the balls to adhere to these walls and it becomes difficult to get the balls to pass through the passageway around the barrier.

While this invention has been described with reference to a particular embodiment thereof, it is apparent that many other forms and embodiments thereof will be obvious to those skilled in the art in view of the foregoing disclosure. Thus, the scope of the invention is defined in the appended claims.

I claim:

1. An amusement device for challenging one's ability to position objects within a given area therein because of a static charge, comprising; a transparent elongated and enclosed container made from an electrically insulating material, having a plurality of small movable objects also made from an electrically insulating material encased within said container, said container further having at least one barrier transversely disposed therein thereby dividing the container into a plurality of intercommunicating chambers including two outermost chambers, said outermost chambers being symmetrical with respect to the barrier, the said at least one barrier having a passageway to enable movement of the movable objects from one chamber to another, and the movable objects being of such size and weight to enable them to adhere to the side walls of the container in its charged condition.

2. The amusement device as defined in claim 1 wherein the movable objects which, when not affected by a static electrical charge, are capable of being easily moved along a given path between said chambers.

* * * * *